United States Patent [19]

Blakeway

[11] 4,097,562

[45] Jun. 27, 1978

[54] CARBURETOR

[75] Inventor: Douglas Hayward Blakeway, Burnaby, Canada

[73] Assignee: Blakeway Industries Ltd., North Vancouver, Canada

[21] Appl. No.: 806,142

[22] Filed: Jun. 13, 1977

Related U.S. Application Data

[63] Continuation-in-part of Ser. No. 628,759, Nov. 4, 1975, abandoned.

[51] Int. Cl.[2] ..... F02M 11/08

[52] U.S. Cl. ..... 261/41 B; 261/44 B; 261/DIG. 39

[58] Field of Search ..... 261/44 B, 44 A, 41 B, 261/50 R, DIG. 39

[56] References Cited

U.S. PATENT DOCUMENTS

| | | | |
|---|---|---|---|
| 804,025 | 11/1905 | Minton | 261/44 R |
| 1,165,224 | 12/1915 | Cadett | 261/62 |
| 1,839,102 | 12/1931 | Kessel | 261/44 A |
| 1,862,434 | 6/1932 | Schaffner | 261/62 |
| 2,655,357 | 10/1953 | Steffen | 261/44 G |
| 2,995,349 | 8/1961 | Kennedy, Sr. | 261/44 A |
| 3,007,683 | 11/1961 | McCracken | 261/50 R |
| 3,026,095 | 3/1962 | Trammell et al. | 261/50 R |
| 3,086,758 | 4/1963 | Greene | 261/44 R |
| 3,220,709 | 11/1965 | Pickron et al. | 261/44 A |
| 3,875,917 | 4/1975 | Scarritt, Sr. | 261/44 R |
| 3,937,767 | 2/1976 | Chapman | 261/41 B |

FOREIGN PATENT DOCUMENTS

| | | | |
|---|---|---|---|
| 224,263 | 11/1924 | United Kingdom | 261/44 R |

*Primary Examiner*—Tim R. Miles

*Attorney, Agent, or Firm*—Carver and Company

[57] ABSTRACT

Carburetor for mixing air and fuel for internal combustion engines having fuel spray tube extending into throat to produce air/fuel mixture for combustion. Valve assembly has two similar sliding gate valve members which slide transversely across throat equal amounts in opposite directions and cooperate with tube. Fuel metering means coupled to valve members meters flow of fuel through fuel spray tube in amounts proportional to valve opening. In preferred embodiment spray tube has air bleed and discharge jet means spaced along tube which communicate with mixing manifold within tube and are closed concurrently by valve members as valve members approach each other. Air bleed jets admit air into fuel spray tube which mixes with metered fuel in manifold to form primary rich air/fuel mixture which discharges to produce desired leaner mixture.

28 Claims, 15 Drawing Figures

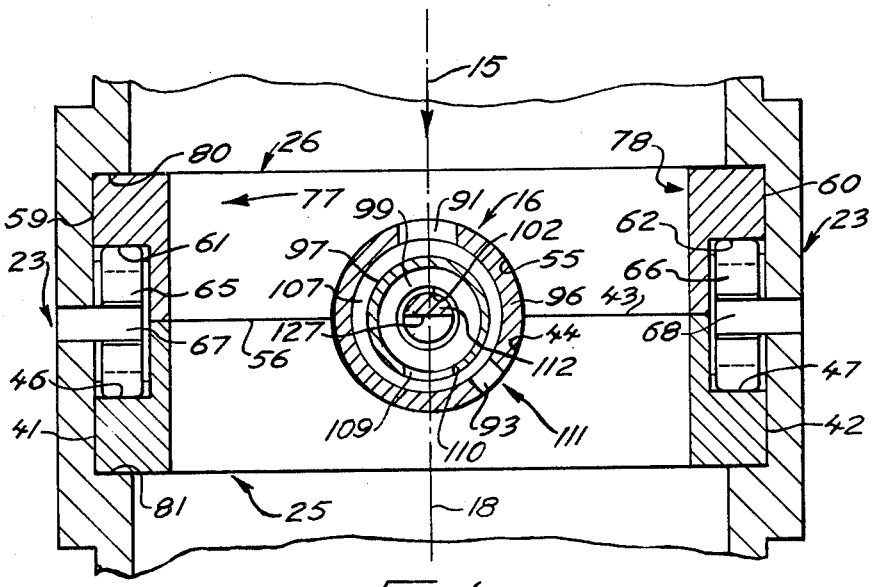
Fig. 4
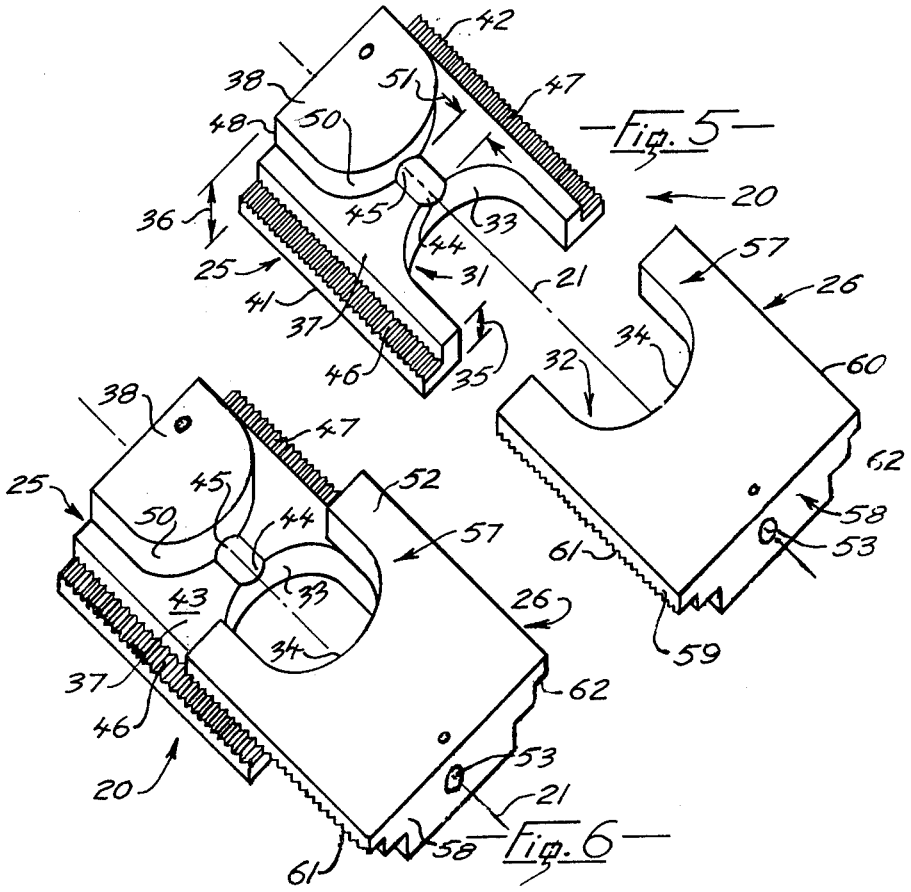
Fig. 5
Fig. 6

CARBURETOR

CROSS REFERENCES TO OTHER APPLICATIONS

This is a continuation-in-part of my application Ser. No. 628,759 filed Nov. 4, 1975 entitled CARBURETOR, now abandoned.

BACKGROUND OF THE INVENTION

1. Field of the Invention

The invention relates to a carburetor for mixing air and fuel prior to combustion, as used in an internal combustion engine.

2. Prior Art

Carburetors have been known for many years, the common type of carburetor having a throat with a venturi and being provided with a butterfly valve for controlling air flow through the throat. Fuel is drawn by suction at the venturi to discharge through a jet as a fine spray into the throat. For automotive applications, usually the carburetor has several jets and fuel delivery circuits to maintain desired air/fuel ratios for all engine conditions. Normally a separate choke and a rich fuel circuit is required for starting, and for acceleration an accelerator pump to inject a measured amount of fuel into the throat is commonly provided. Modern automobile carburetors are relatively complex and are prone to blockage from dirty fuel and, with increasingly strict air pollution standards, are known to be relatively inefficient for atomization and mixing of the fuel.

A common fault with many modern carburetors relates to the "flat spots" occuring when the engine accelerates and the fuel flow transfers from one fuel circuit to another, for example from the idling circuit, into the accelerating circuit. The flat spot is known to result from the discontinuity in the air/fuel ratios between the two circuits, and further complicated structures have been devised to reduce the effects of such flat spots.

SUMMARY OF THE INVENTION

The invention reduces some of the difficulties of the prior art by providing a mechanically very simple carburetor which uses one fuel circuit for all engine conditions and eliminates the venturi, choke and accelerator pump. Because one fuel circuit only is used, flat spot difficulties associated with the prior art carburetors are eliminated. Furthermore, the carburetor according to the invention is self-cleaning to a limited extent, is physically compact and provides a relatively constant air/fuel ratio for most engine conditions.

The carburetor according to the invention includes a body having a throat with a throat central axis and a side wall, a fuel spray tube extending into the throat generally normally to the throat central axis and adapted to receive fuel and to discharge fuel into the throat, and a valve assembly. The valve assembly has a valve axis extending across the throat and normally to the throat central axis, first and second sliding gate valve members, and a complementary valve guide means to mount the valve members for generally transverse sliding along the valve axis between closed and wide open positions. Each valve member has an inner portion having an inner edge disposed generally symmetrically about the valve axis and shaped so as to correspond to approximately one half of the side wall of the throat when in the wide open position. The valve members are adapted to cooperate with each other so that inner portions thereof overlap each other to close essentially the throat in the closed position, and also to cooperate with the jet means of the fuel spray tube. The carburetor also includes a valve actuating means, a fuel metering means and a fuel atomizing means. The valve actuating means cooperates with the valve members to move the valve members concurrently in opposite directions between the respective open and closed positions in response to an operator control so that movement of the members controls the jet means. The fuel metering means is responsive to valve position and meters fuel prior to being discharged from the fuel spray tube. The fuel atomizing means cooperates with the jet means of the fuel spray tube so as to discharge into the throat an acceptable fuel mixture for combustion for all valve positions.

The fuel atomizing means can also be used, with suitable modifications, in a conventional carburetor with a common valve means for controlling air flow through the throat, for example a butterfly valve. The fuel atomizing means includes the fuel spray tube extending into the throat and being characterized by discharge jet means extending substantially across the throat and positioned so as to be exposed to suction resulting from air flowing around the spray tube. The fuel spray tube includes a manifold extending substantially across the throat and communicating with the discharge jet means, and a fuel orifice positioned midway across the throat to discharge metered fuel into the manifold for distribution to the discharge jet means.

A detailed disclosure following, related to drawings, describes preferred embodiments of the invention which, however, is capable of expression in structure other than that particularly described and illustrated.

DESCRIPTION OF THE DRAWINGS

FIG. 4 is a simplified transverse section on Line 4—4 of FIG. 1, FIG. 5 is a simplified perspective showing valve members separated beyond the wide open position, FIG. 6 is a simplified perspective showing the valve members cooperating in a partially open position.

DETAILED DISCLOSURE

FIGS. 1 through 6

Figure 1:
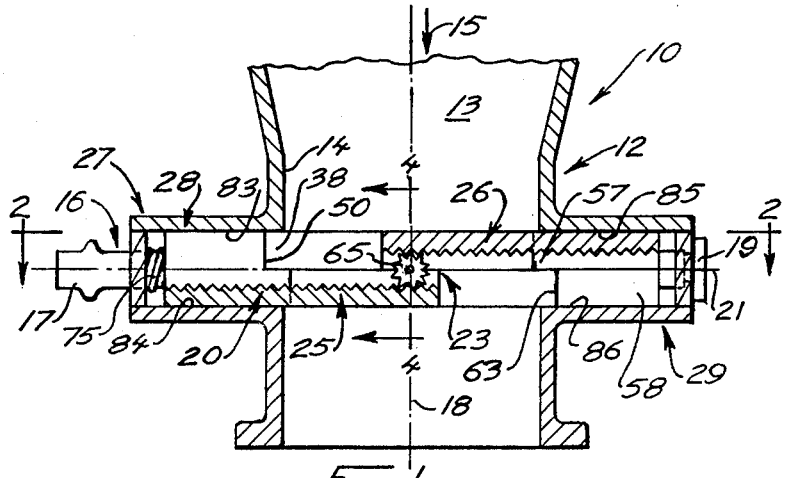
FIG. 1 is a simplified fragmented section through a portion of the carburetor, portions of the carburetor being removed to show valve actuating mechanism and valve members in open positions.
Figure 2:
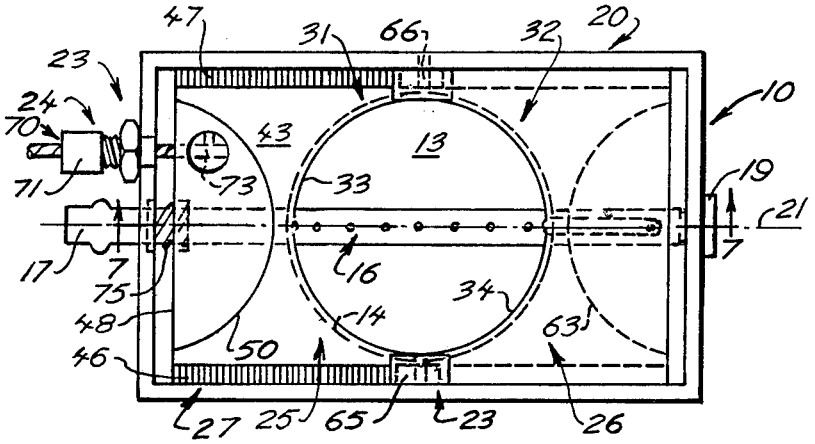
FIG. 2 is a simplified section on Line 2—2 of FIG. 1 showing the valve members in wide open positions.
Figure 3:
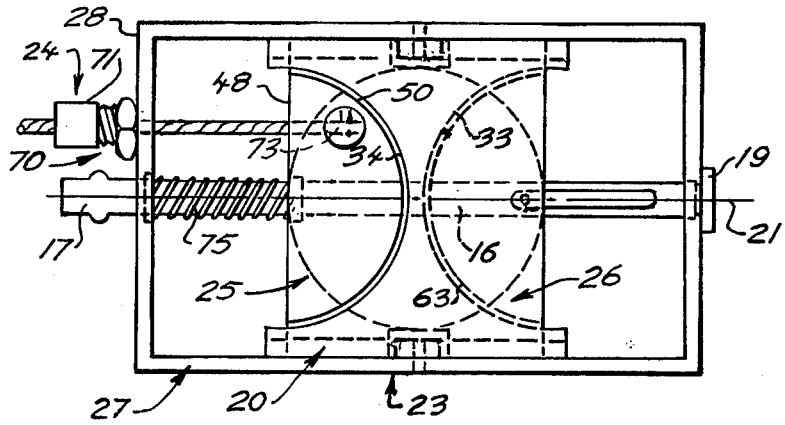
FIG. 3 is a simplified section on Line 2—2 of FIG. 1, the valve members being shown in closed positions.
Figure 11:
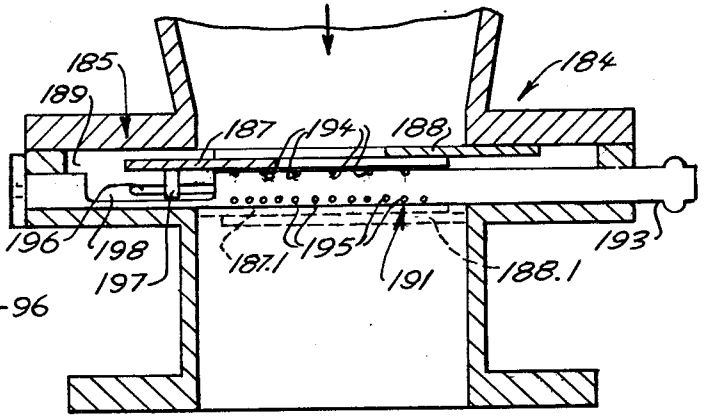
Figure 12:
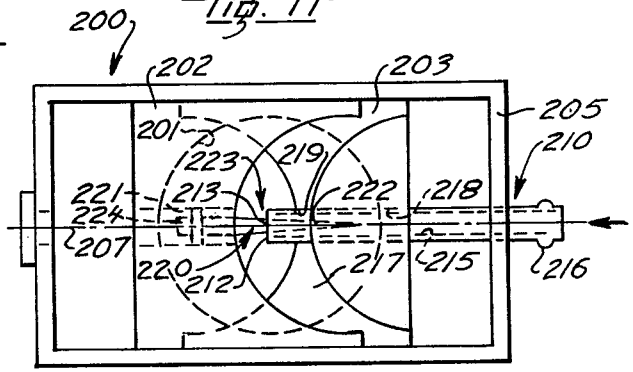

Referring particularly to FIGS. 1 through 3, a carburetor 10 for mixing air and fuel prior to combustion includes a body 12 having a throat 13 with a cylindrical side wall 14. Air enters the carburetor from an intake stack in the direction of an arrow 15, in response to reduced induction pressure. A fuel spray tube 16 extends across and between opposed portions of the throat and has a fuel inlet 17 at one end to receive fuel and a plug 19 at an opposite end and is adapted to discharge fuel into the throat by means to be described. The carburetor has a throat central axis 18 and a valve assembly 20 having a valve axis 21 extending across the throat on a diameter thereof. Thus the spray tube 16 and the valve axis 21 extend normally to the throat axis 18. The valve assembly is controlled by valve actuating means 23 coupled by a valve control link 24 to an operator control (not shown).

The valve assembly includes first and second sliding gate valve members 25 and 26 and a complementary valve guide means 27 to mount the valve members for generally transverse sliding along the valve axis between an open position of the valve shown in FIG. 2 and a closed position shown in FIG. 3. The valve members 25 and 26 have inner portions 31 and 32 provided with concave inner edges 33 and 34 respectively, the inner edges being disposed generally summetrically about the valve axis and being shaped to correspond to approximately one half of the side wall 14 of the throat when in the wide open position. As seen in FIG. 2, when the carburetor is open the inner edges 33 and 34 are not necessarily flush with the throat side wall, but can project into the throat from the side wall to produce turbulence in the air flow which improves the mixing of the fuel with the air. If maximum air flow through the throat is a major consideration the inner edges 33 and 34 should retract to be flush with the throat side wall in the wide open position. The guide means 27 has oppositely extending valve guide projections 28 and 29 to receive and support outer portions of the valve members 25 and 26 respectively in the wide open position, and to support outer portions of the tube 16.

As best seen in FIGS. 4, 5 and 6, the valve member 25 has first and second portions 37 and 38 having thicknesses 35 and 36 respectively, the thickness 36 being approximately twice the thickness 35. The first portion is a generally rectangular slab having a pair of spaced parallel side edges 41 and 42 adapted to slide in the valve guide means 27, and the concave inner edge 33. The first portion 37 has a face 43 with an axial groove 44 to accept approximately one-half of the fuel spray tube 16, the face having a periphery defined in part by portions of the second portion, the edges 33, 41 and 42 and an outer edge 48 of the valve member. The face 43 also has a pair of gear racks 46 and 47 extending parallel to and adjacent the side edges 41 and 42 of the member between spaced inner edges of the inner portion 31 and the outer edge 48.

The second portion 38 has an axially disposed passage 45 aligned with the groove 44 in the face 43 so as to accept the fuel spray tube 16 which passes through the second portion to the outer edge 48. The second portion has a convex semi-cylindrical inner wall 50 spaced outwards from the inner edge 33 a distance 51 as measured along the valve axis, which distance defines valve overlap. Thus the groove 44 extends between mid-positions of the convex inner wall 50 and the concave inner edge 33.

The second valve member 26 is generally similar to the first valve member and has first and second portions 57 and 58 and a passage 53 in the second portion aligned with a groove 55 extending across a face 56 of the first portion 57, forming a valve overlap. The passages 45 and 53 and the grooves 44 and 55 of the valve members are mutually aligned for all positions of the valve members to permit free sliding of the members along the fuel spray tube 16. The first portion 57 has parallel side edges 59 and 60 with gear racks 61 and 62 extending parallel to and adjacent the side edges 59 and 60.

The valve members 25 and 26 are mounted in the valve guide means 28 in opposite relationship to each other, so that faces 34 and 56 of the respective first portions are positioned so as to be adjacent to each other. As best seen in FIG. 6, the concave inner edge 34 of the first portion 57 of the valve member 26 is complementary to the convex inner wall 50 of the second portion 38 of the valve member 25. Similarly, the second portion 58 of the valve member 26 has a convex inner wall 63 (shown in FIGS. 1, 2 and 3) which is complementary to the inner edge 33 of the valve members 25. Because the concave inner edge and convex inner wall of one valve member is complementary to the concave inner edge and convex inner wall of the other valve member, when the valve is closed, air flow through the carburetor is restricted. The degree of restriction can be adjusted by changing equally on each valve member the width of the valve overlap and degree of fit of the complementary portions of the valve members. When closed a relatively small amount of air can flow around the side edges of the valve members between the guide means and this is sufficient to provide cool air for cooling the cylinder after the engine has been switched off but is still rotating. The air flowing around the edges of the valve member remote from the throat thus by-passes the fuel spray tube and thus does not draw fuel into the engine which, in some cases, would otherwise tend to initiate ignition even when the engine has been switched off. Thus this is an air by-pass means and the amount of air being by-passed can be adjusted by selecting particular clearances between the valve members and guide means. It is important that negligible air by-passes the fuel spray tube when the valve members are open and the engine is operating as this would cause eratic running due to undesirable variations in air/fuel ratio.

As best seen in FIG. 4, a pair of similar gear wheels 65 and 66 are journalled on pins 67 and 68 extending inwards from the valve guide means 27, the gear wheels meshing with the opposed racks 46 and 61, and 47 and 62 respectively of the valve members, to provide a simple rack and pinion mechanisms on each side of the fuel spray tube. The rack and pinion mechanisms automatically couple the valve members together so as to move equal amounts in opposite directions. The valve members and gear wheels can be made from injection molded plastic so that lubrication problems are reduced and the tolerances obtainable with precision injection moldings permit economical mass production of the major components of the valve mechanism. For a given movement of one valve member, change in opening between the valve members is twice that that would be obtained if only one valve member moved. Thus the valve assembly has a particularly fast response for a given control movement when compared with a single plate valve. Furthermore, the movement of the valve members is symmetrical relative to the throat for all valve positions, which also contrasts with a single plate valve.

The valve control link 24 includes a sheathed control cable 70, such as a Bowden cable, having an outer end 71 of the sheath thereof secured to the projection 28 of the valve guide means, and an outer end 73 of an inner wire thereof secured to the valve member 25. Inner ends (not shown) extend to an operator's throttle control, for example, the hand grip of a motor cycle, or the accelerator pedal linkage of an automobile. Compression spring means 75 enclose a portion of the fuel spray tube 16 and extend between the valve guide means and the outer edge 48 of the member 25 to apply a closing force to the valve member tending to move it to the closed position. The closing force is applied along the axis 21 and aligned with the tube 16 which also is a guide and thus jamming tendency is reduced. The throttle is opened by drawing the wire outer end 73 outwards, thus compressing the spring means 75 and moving the valve member 25 outwards which, through the gear wheels 65 and 66 concurrently moves the valve member 26 outwards, i.e. in the opposite direction. Thus the gear wheels 65 and 66, the gear racks 46, 47, 61 and 62 and the control cable 70 serve as valve actuating means cooperating with the valve members to move the valve members concurrently in opposite directions between the respective open and closed positions in response to an operator control. It is noted that the gear wheels are rotatable means journalled for rotation relaive to the carburetor, and alternative and equivalent valve actuating means and rotatable means are disclosed with reference to FIGS. 8 and 9.

As best seen in FIGS. 1 and 4, the valve guide means 27 includes open rectangular recesses 77 and 78 on opposite sides of the spray tube, and recess 77 having opposed parallel walls 80 and 81 which restrict the valve members against rocking relative to the valve axis as the valve members move between extreme positions. Additional support for the valve members is obtained by opposed inner faces 83 and 84 of the valve guide projections 28 (shown in FIG. 1 only), which inner faces engage upper and lower faces respectively of inner and outer portions of the valve members. Similarly, inner faces 85 and 86 of the valve guide projection 29 engage upper and lower faces respectively at opposite ends of the valve members. It can be seen that the valve members are thus supported along the side edges thereof for all positions of the valve members with additional support of the inner and outer portions of the valve members when in extreme positions. This produces smooth sliding of the valve members along the guide means and also along the fuel spray tube with little tendency to jam through non-alignment.

Figure 7:
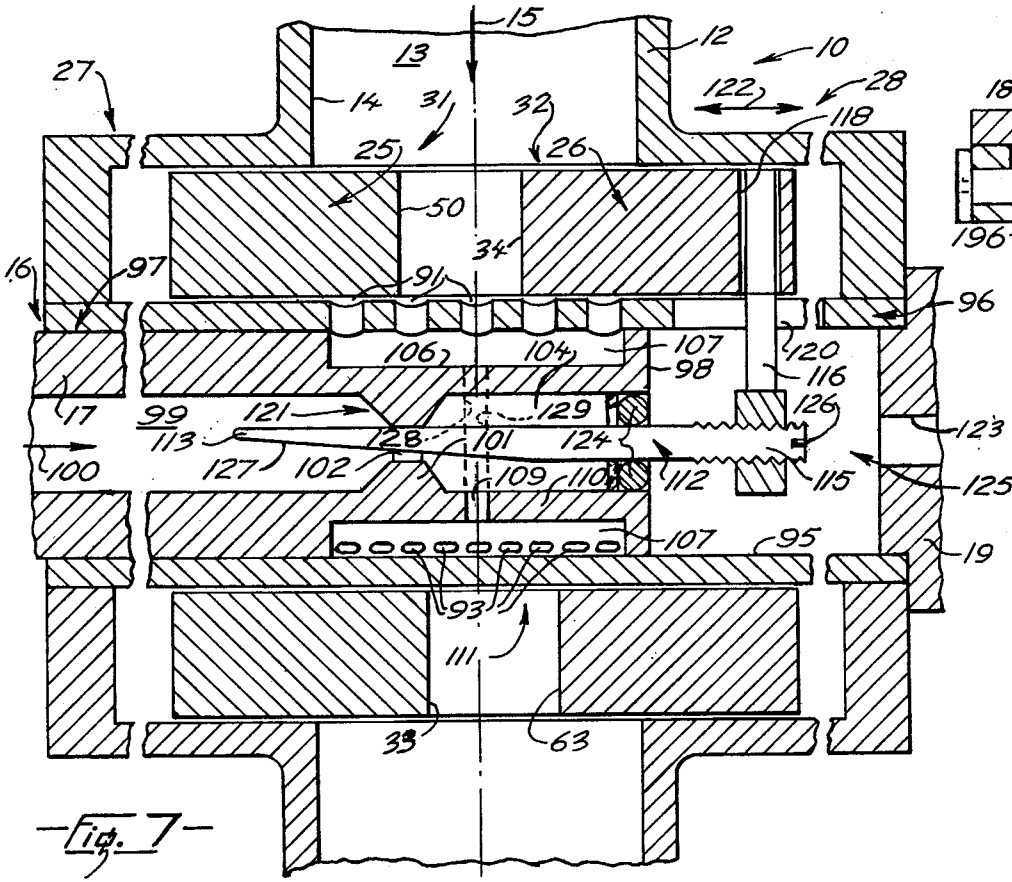
FIG. 7 is a simplified section on Line 7—7 of FIG. 2, the valve members and fuel metering means being shown in half open positions.

FIGS. 4 and 7

Referring mainly to FIG. 7, the fuel spray tube 16 has a plurality of air bleed jets 91 spaced along the tube and facing generally upstream to inlet air flow, shown as the arrow 15, so as to receive a portion of ram air entering the carburetor. The fuel tube also has a plurality of discharge jets 93 spaced along the tube and positioned so as to be exposed to suction resulting from air flowing around the spray tube. In some conditions suction can also be generated by air flow around the inner portions 31 and 32 of the valve members which augments suction produced by air flowing around the tube. The air bleed jets and discharge jets extend in rows between opposite portions of the side wall of the throat and are equally spaced. The air bleed jets are larger, spaced further apart and fewer in number than the discharge jets for reasons to be described. As best seen in FIG. 4, the discharge jets are positioned on the periphery of the tube at about 45 degrees to the main direction of air flow at a position where suction is generated as air flows past the tube 16. Preferably most of the air entering the air bleed jets 91 cannot pass directly out through the discharge jets 93 and thus the discharge jets are non-aligned with the air bleed jet means.

As best seen in FIG. 7, portions of the valve members having the passages 45 and 53 and the grooves 44 and 55 respectively partially enclose portions of the fuel spray tube adjacent opposite portions of the throat. Thus, as the valve assembly closes, the valve members move towards each other and the air bleed jets and the discharge jets adjacent opposite portions of the throat are progressively closed by the valve members. It is noted that as the valve member 25 moves inwards, the valve overlap of the member 25 closes the discharge jets ahead of the air bleed jets. Likewise as the member 26 moves inwards, its valve overlap closes the air bleed jets ahead of the discharge jets.

The fuel spray tube 16 is characterized by an outer sleeve 96 having a central bore 95 and the rows of air bleed and discharge jets 91 and 93 respectively, and an inner tube 97 which is a snug fit within the central bore 95. The inner tube 97 has a central bore 99 for receiving fuel from a fuel line (not shown) connected to the fuel inlet 17 and entering the bore in direction of an arrow 100. The fuel line receives fuel from a constant head device such as a common float chamber or constant pressure delivery pump (not shown). The central bore 99 has a restriction 101 defining a fuel flow jet 102 which communicates with a discharge chamber 104 on a side of the restriction remote from the inlet 17. An inner end 98 of the tube 97 has an annular groove 106 extending therearound, which defines with a portion of the central bore 95 of the outer sleeve 96 and opposed shoulders of the groove 106 an annular manifold 107 within the tube 16. The manifold 107 extends between the upstream and downstream portions of the bore 95 and along the spray tube between extreme outer positions of the air bleed and discharge jets and connects the air bleed jets to the discharge jets. A fuel orifice 109 passing through an inner wall 110 of the manifold connects the discharge chamber 104 to a downstream portion of the manifold and thus is disposed relative to the air bleed jet means so as to be essentially sheltered from direct flow of air entering the air bleed jet means. The fuel orifice 109 is on the throat axis 18 and thus is disposed approximately mid-way across the throat 13 to ensure central distribution of fuel into the manifold, ie. at a mid-position of the manifold to provide generally even distribution of fuel to the discharge jets. Thus fuel passes along the bore 99, through the fuel jet 102, into the discharge chamber 104, through the fuel orifice 109 and then generally equally to opposite ends of the manifold 107. Ram air that enters the air bleed jets 91 flows around the annular groove 106 and mixes with fuel discharged from the fuel orifice 109. Some atomization of the liquid fuel may take place here, but mostly air is mixed with fuel droplets to form a relatively rich primary air/fuel mixture which is then drawn through the fuel discharge jets 93 to atomize in the suction adjacent the jets 93. This subsequent atomization at the jets 93 is assisted by air turbulence and suction resulting from air flow passing the inner portions 31 and 32 of valve members. The air bleed jets preferrably have a total area greater than the discharge jets so as to pass an adequate volume of air to initiate primary mixing of the metered fuel. The discharge jets are relatively fine openings to improve atomization. Thus the air bleed jets 91, the fuel orifice 109, the manifold 107 and discharge jets 93 serve as fuel atomizing means 111.

A fuel needle 112 has a tapered outer end 113 passing through the fuel flow jet 102 and an inner end 115 releasably connected to an inner end of an arm 116. The arm 116 has an outer end fitted in an opening 118 in the valve member 26, and a portion of the outer sleeve 96 has an longitudinal slot 120 to provide clearance for the arm 116 to pass therethrough. As can be seen, as the valve member 26 moves axially between open and closed positions in directions shown by a double-headed arrow 122, the tapered end 113 of the fuel needle moves axially through the fuel flow jet 102 varying degree of restriction of the fuel jet thus serving as a fuel metering means 121. The slot 120 thus has a length equal to at least total stroke of one valve member to accommodate full movement of the valve member between extreme positions. An "O" ring seal 124 encircles an inner parallel portion of the fuel needle essentially to prevent loss of fuel through an outer end of the discharge chamber 104. Thus the arm 116 serves as a coupling means 125 which connects the fuel needle to an adjacent valve means so that axial movement of the valve member is reflected by the needle. The plug 19 has an opening 123 to accept a screw driver (not shown) for engagement with a screw driver slot 126 at the inner end 115 of the needle 112 for turning the needle in the arm 116 for axial adjustment of the needle. The needle 112 can thus be moved axially relative to the arm 116 for "zeroing" the needle relative to the jet 102.

As best seen in FIG. 4, the needle has a flat portion 127 inclined to a central axis of the needle, so that cross-sectional area of the needle varies along the length thereof. Thus when the needle 112 cooperates with the jet 102, with a constant fuel supply pressure, the fuel flow through the fuel jet is metered an amount dependent on cross-sectional area of that portion of the needle which cooperates with the jet. The tapered needle 112 thus serves as a variable fuel flow restricter which cooperates with the fuel jet to vary degree of restriction of the fuel jet. Because the needle is connected to the valve member 26, relative position of the flow restricter in the jet is dependent on position of the valve member, which is related to volume of air flowing through throat. The flat portion 127 is preferrably disposed adjacent the fuel orifice 109 so as to provide a relatively direct route between the fuel jet and the fuel orifice, and this relative disposition can usually be attained after rotation of the needle 112. The fuel orifice is no smaller than the jet 102 when fully open so as not to restrict flow from the chamber 104. It is seen that as the needle moves in the jet 102, it would tend to clean it of a blockage, thus making the carburetor self-cleaning to a limited extent.

In an alternative fuel spray tube, the inner tube 97 can be divided into two portions having opposed end faces 128 and 129, (broken outline in FIG. 7) the end faces being spaced apart adjacent a mid-position of the throat so as to expose the central bore. Thus the end face 128 has the central bore therein which thus serves as the fuel orifice and it can be seen that some of the ram air passing through the air bleed jets will tend to pass directly across the face 128 thus initiating atomization.

In summary, it can be seen that the carburetor has the fuel metering means 121 and the fuel atomizing means 111 positioned within the fuel spray tube, in which the fuel metering means is responsive to valve position to meter fuel discharged from the fuel spray tube, and the fuel atomizing means cooperates with the fuel spray tube so that as the valve closes, volume flow of air entering the air bleed orifices is controlled by selectively closing air bleed jets simultaneously with the discharge jets. It is noted that the air bleed jets communicate with the discharge jets and a supply of metered fuel so that the metered fuel and the ram air in the manifold discharge simultaneously through the discharge jet means.

OPERATION

A portion of ram air entering the carburetor throat enters the fuel spray tube through the air bleed jets 91 and passes through the manifold 107 to leave the fuel spray tube through the discharge jets 93. This portion of air concurrently mixes initially with metered fuel passing through the fuel orifice 109 to form the relatively rich primary air/fuel mixture in the manifold 107, which then discharges through the discharge jets 93 for subsequent mixing with air in the throat downstream from the spray tube to produce a desired leaner air/fuel mixture for combustion. It can be seen that, as the carburetor closes, air bleed and discharge jets are closed progressively from each end of the tube, thus proportioning ram air fed into the jets and fuel discharged from the jets in an amount generally proportional to air flowing through the carburetor. Note that fuel metering is determined primarily by position of the fuel needle 112 in the fuel jet 102, with some adjustment being possible by varying ram air fed into the mixing manifold.

ALTERNATIVES AND EQUIVALENTS

The spray tube 16 has the plurality of air bleed jets 91 and discharge jets 93 spaced along the tube between the side wall of the carburetor throat. If required, size and spacing of the jets can be varied to accommodate air flow variations across the throat, or to accommodate different air/fuel mixtures for different valve positions. Two rows of discharge jets can be provided symmetrically on opposite sides of the fuel spray tube so as to be exposed to the suction, and if desired can be staggered relative to each other for even dispersion of fuel into the air stream.

Alternatively, the air bleed jet can be a narrow axial slit extending along an upstream portion of the spray tube and the discharge jet can be a similar narrow slit extending along a portion of the fuel spray tube exposed to suction. This would produce a continuously varying area of air bleed jet or discharge jet exposed to air flow, contrasting with the plurality of jets which is discontinuous or incremental. The slits could taper to provide non-linear area characteristics to attain desired air/fuel ratios for all valve positions. Alternatively one air bleed jet and one fuel discharge jet can be provided at the middle of the tube, i.e. mid-way across the throat. This latter alternative does not have extensive or progressive closing of jets as the valve closes, from the wide open positions until the valve members approach edges of the jets. All structures above are termed air bleed jet means and discharge jet means.

The fuel atomizing means can be used also as a substitute for the fuel jets in a conventional carburetor having common valve means for controlling air flow through the throat, for example a butterfly valve. The atomizing means includes a fuel spray tube extending into the throat, the tube having discharge jet means extending substantially across the throat and positioned so as to be exposed to suction resulting from air flowing around the throat. The fuel spray tube includes a manifold extending substantially across the throat and communicating with the discharge jet means, and a fuel orifice positioned mid-way across the throat to discharge metered fuel into the manifold for distribution to the discharge jet means. It is noted that in this simplified arrangement the air bleed jets can be eliminated and thus metering of ram air or pre-mixing in the tube to form the rich primary mixture is eliminated. In the simplified arrangement with an alternative valve means, the valve means is not coupled to the fuel metering means and does not cooperate with the discharge jets to proportion the exposure of discharge jets to valve opening. Thus valve coupling of the metering means and jets is eliminated and the atomizing means provides a distribution of atomized fuel across a diameter of the throat in which the fuel has been previously metered by the existing jets in the carburetor. The existing jets regulate fuel supply to the fuel tube in an amount dependent on suction at the discharge jets. It is noted that the fuel metering means is now remote from the carburetor throat and the spray tube, and mostly would still require only one fuel circuit. Thus this simplified alternative provides a conversion kit for an existing common carburetor to give the advantages of essentially even diametrical distribution of atomized fuel which has been metered in an amount dependent on throat suction.

Alternative valve actuating means, fuel atomizing means and relative dispostions of the valve members and spray tubes are described with reference to FIGS. 8 through 12 as follows.

Figure 8:
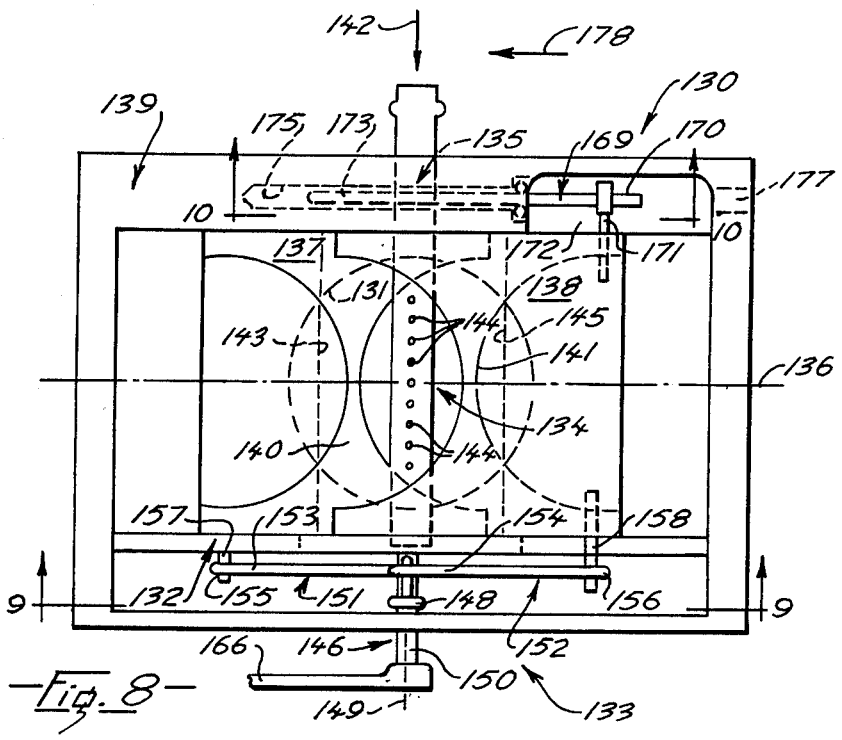
FIG. 8 is a simplified top plan of a first alternative carburetor, valve members thereof being shown in half open positions.
Figure 9:
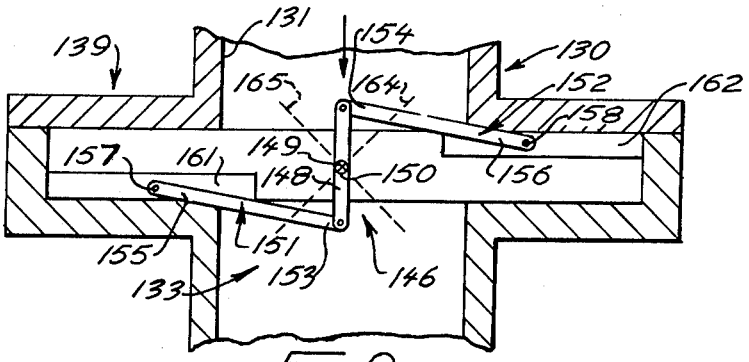
FIG. 9 is a simplified section generally on Line 9—9 of FIG. 8, the valve members being shown in the half open positions, some portions being removed.
Figure 10:
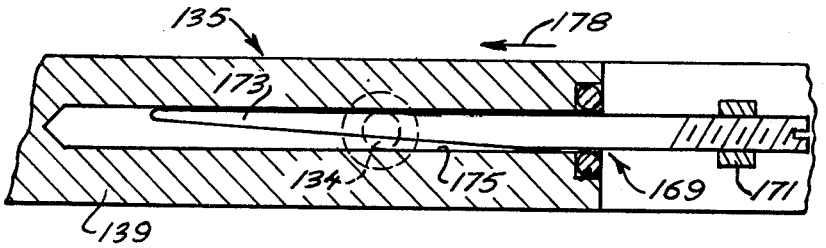
FIG. 10 is a simplified section generally on Line 10—10 of FIG. 8, a fuel metering means being shown in a half open position, some portions being removed, FIG. 11 appearing on Sheet 3 of the drawings, is a simplified section of a second alternative carburetor, FIG. 12 appearing on Sheet 3 of the drawings, is a simplified top plan of a third alternative carburetor, some portions being removed.

FIGS. 8 through 10

Referring initially to FIG. 8, an alternative carburetor 130 having a throat 131 has an alternative valve assembly 132 actuated by an alternative valve actuating means 133, and an alternative fuel spray tube 134 having an alternative fuel metering means 135. The valve assembly 132 has a valve axis 136, and first and second valve members 137 and 138 mounted in valve guide means 139 and adapted for the transverse sliding along the valve axis between closed and wide open positions. The valve members and the valve guide means are generally similar to the valve guide means of FIG. 1, with differences as follows. As seen in FIG. 8, a major difference from the carburetor 10 of FIG. 1 relates to the fuel spray tube 134 which extends diametrically across the throat normally to the valve axis 136 of FIG. 8, in contrast to the tube 16 of FIGS. 2 and 3 which extends parallel to the valve axis. The tube 134 receives fuel in direction of an arrow 142 from a fuel supply (not shown). Inner portions 140 and 141 of the members 137 and 138 have additional clearance 143 and 145 to receive the fuel spray tube 134 transversely so as to extend over downstream and upstream sides of the tube respectively so as to sandwich the fuel tube. Thus the passages 45 and 53 and grooves 44 and 55 of the valve members 25 and 26 of FIGS. 1 through 6 are eliminated. The fuel spray tube 134 has a plurality of air bleed jets 144 and discharge jets (not shown) on the upstream and downstream sides of the tube respectively, which are generally similar to the jets 91 and 93 of the fuel spray tube 16 of the carburetor 10. The fuel spray tube 134 cooperates with the valve members 137 and 138 so that jets adjacent opposite portions of the throat are progressively closed by the valve members as the valve assembly closes, similarly to the structure of FIG. 1. The tube 134 has a manifold and a related centrally disposed fuel orifice (neither of which are shown) similarly to the tube 16.

The valve actuating means 133 eliminates and is a substitute for the rack and pinion mechanism of the means 23 of FIG. 1. Referring also to FIG. 9, the means 133 has a lever mechanism 146 which includes a lever 148 secured at a mid-point thereof to an axle 150 which is journalled for rotation about an axis 149 disposed diametrically to the carburetor throat. The axis 149 is shown to be aligned with the fuel spray tube 134 although alternative locations are envisaged. A pair of links 151 and 152 have inner ends 153 and 154 connected to opposite ends of the lever 148, and outer ends 155 and 156 journalled on pins 157 and 158 extending transversely from the valve members 137 and 138 as shown. The pins 157 and 158 extend through axial slots 161 and 162 in the valve guide means and are thus constrained to move in planes parallel to the valve axis. As can be seen in FIG. 9 rotation of the axle 150 rotates the lever 148 between its valve open position 164 and its valve closed position 165 resulting in concurrent mutual sliding of the valve members equal amounts in opposite directions. A control arm 166 secured to an outer end of the axle 150 is connected to an operator control, for example the throttle lever, through control link means (not shown), with return spring means (also not shown) as required.

The fuel metering means 135 is positioned remote from the throat 131 and within one portion of the guide means 139. As seen in FIGS. 8 and 10, the means 135 includes a tapered fuel needle 169 which cooperates with the tube 134 to meter flow through a longitudinal bore thereof as follows. The needle has a tapered outer end 173, and an inner end 170 threaded on to an arm 171 extending from the valve member 138 into a clearance slot 172 in the valve guide means. The valve guide means has a parallel bore 175 adapted to receive the end 173 and the fuel spray tube 134 passes through that portion of the valve guide means and is pierced by the bore 175. Thus the outer end 173 of the needle passes transversely across the longitudinal bore of the fuel spray tube to meter fuel flow therethrough. The end 170 has a screw driver slot and the valve guide means 139 has a clearance bore 177 to accept the screw driver for rotation of the needle for axial adjustment of the needle. As can be seen, movement of the valve member 138 in direction of an arrow 178 to close the valve moves the fuel needle inwards, increasing restriction of the fuel spray tube 134, thus decreasing flow of fuel through the metering means 135 in an amount proportional to movement of the valve members.

FIG. 11

A second alternative carburetor 184 has an alternative valve assembly 185 having first and second valve members 187 and 188 formed from flat plates, outer edges of which are adapted to run in valve guide means 189 which are generally similar to the previously described valve guide means. The carburetor has an alternative fuel atomizing means 191 characterized by a fuel spray tube 193 extending across the throat parallel to movement of the valve members. The fuel spray tube has a plurality of air bleed jets 194 and discharge jets 195 spaced along the tube on upstream and downstream sides thereof similarly to the previously described embodiments. The tube 193 is positioned adjacent to and downstream of the valve members so that the valve members close the air bleed jets as required. The first and second portions of the previously described valve members are thus eliminated, together with the passages and grooves to accept the fuel spray tube. Valve actuating means (not shown) such as the lever mechanism 146 of FIG. 8, move the valve members concurrently in opposite directions as previously described. The fuel spray tube is positioned in turbulence produced in the air flow past the valve members to improve atomization and mixing of the fuel. The valve members only restrict entry of ram air into the upstream facing air bleed jets, and provide no restriction for discharge from the discharge jets on the lower surface thereof. A fuel needle 196 cooperates with a fuel flow jet (not shown) within the tube 193 and is threaded onto an arm 197 extending from the valve member 187 into a clearance slot 198 in the tube 193. Thus fuel metering is proportional to valve opening as in the previous embodiments.

Alternatively, the first and second valve members can be fitted on the downstream side of the fuel spray tube 193 as shown generally in broken outline at 187.1 and 188.1. In this alternative position the air bleed jets 194 remain unobstructed for all valve positions, and suction at some of the discharge jets 195 is reduced by the valve members when partially closed. The alternative carburetor 184 provides a simplified structure which could have applications where atomization is less critical.

FIG. 12

A third alternative carburetor 200 has a throat having a side wall 201, and first and second valve members 202 and 203 supported in complementary valve guide means 205 for generally transverse sliding along a valve axis 207. Valve actuating means (not shown) move the valve members concurrently between wide open and closed positions, similarly to the previously described embodiments. A fuel spray tube 210 extends from one side of the carburetor throat half-way across the throat, and has an inner end face 212 positioned adjacent a central axis 213 of the throat. The tube 210 has a longitudinal bore 215 extending inwards from the face 212 and an outer end 216 adapted to be connected to a constant pressure fuel supply so as to receive fuel which passes along the bore 215 to discharge fuel into the throat.

The first valve member 202 is positioned on a side of the throat opposite to the fuel spray tube so that when the first valve member moves to close the carburetor it approaches the tube 210. The valve members are shown in a partially closed position, and the first valve member has a clearance bore 221 to accept an inner portion of the tube 210 to permit essentialy complete closure of the throat by the valve members. The second valve member 203 has a clearance passage 218 to accept the fuel spray tube as a sliding fit therein. The member 203 is generally similar to the second valve member 26 of FIG. 1 and thus has a first portion 217 having a groove to accept a portion of the fuel spray tube and the clearance passage 218 is equivalent to the passage 53 of FIG. 1. Valve overlap similarly to overlap 51 of FIG. 5 is provided as needed.

A fuel needle 220 extends from the first valve member and is aligned with the longitudinal bore 215 of the fuel spray tube so as to enter the longitudinal bore. The fuel needle has an inner end 224 threaded in the bore 221 and a screw driver can be inserted in the bore 221 for axial adjustment of the needle relative to the first valve member. The fuel needle tapers towards an outer end 222 thereof and thus has a cross-sectional area which varies along the length so as to restrict flow of fuel discharged from the longitudinal bore in an amount dependent on relative position of the first valve member and the inner end of the tube. If desired the needle can be clear of the bore in the wide open position, thus providing no restriction to fuel flow, or alternatively the needle can be in the bore even when the carburetor is fully open.

It can be seen that as the valve members move apart, the fuel needle 220 is withdrawn from the longitudinal bore 215 increasing flow of fuel therefrom which discharges from the inner end face 212 to be atomized by air flow flowing past the end face. Thus the fuel needle 220 cooperating with the bore 215 and the inner end face 212 serve as a fuel atomizing and fuel metering means 223, eliminating the manifold and more complex atomizing and mixing means of the previously described embodiments. It is noted that fuel is discharged in the center of the throat, providing generally uniform dispersion across the throat.

Figure 13:
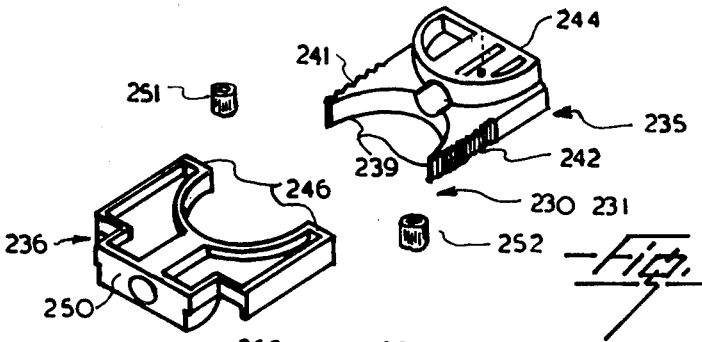
FIG. 13 is a perspective of portions of a disassembled alternative valve actuating means.
Figure 14:
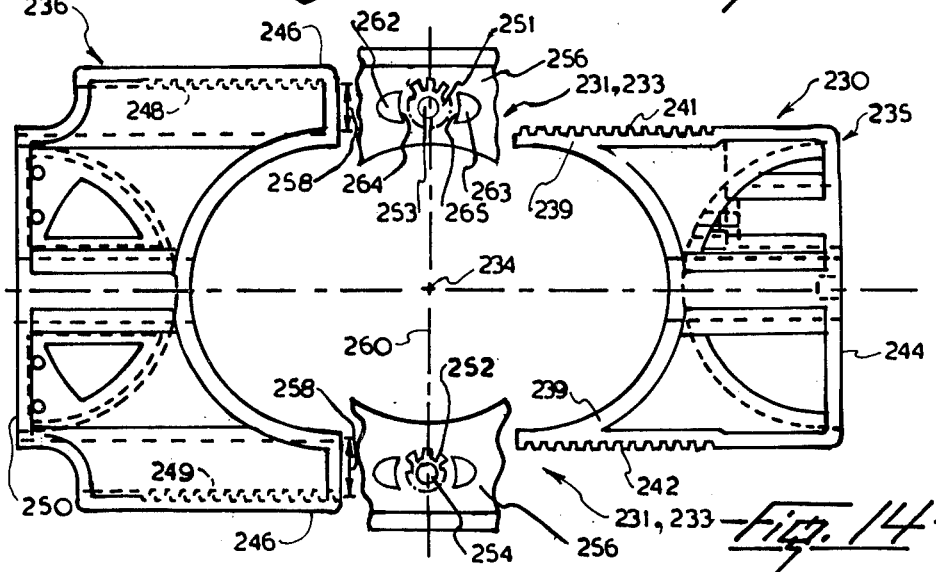
FIG. 14 is a fragmented and disassembled top plan of portions of a fourth alternative carburetor using the alternative actuating means of FIG. 13.
Figure 15:
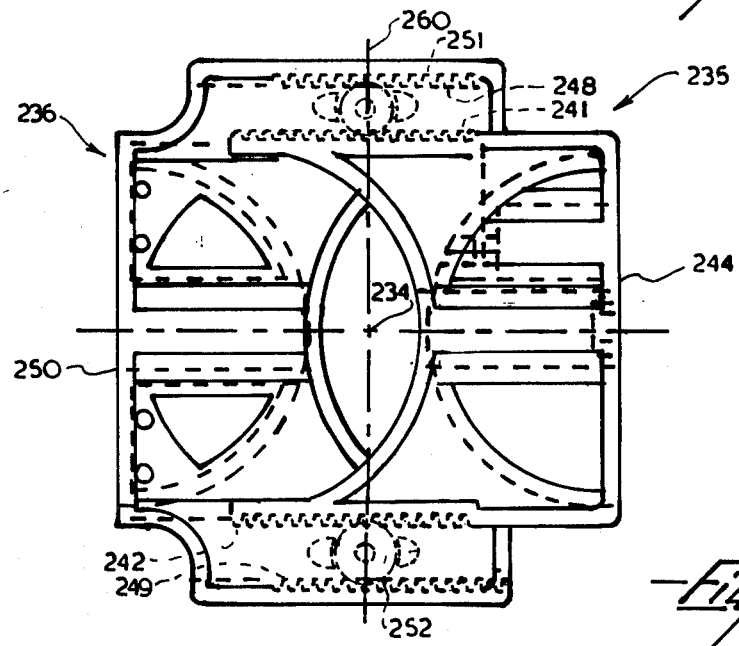
FIG. 15 is a fragmented top plan showing the alternative valve actuating means with valve members thereof in a partially open position.

FIGS. 13 through 15

An alternative air valve means 230 has an alternative valve actuating means 231 which can be substituted for the valve actuating means 23 of FIGS. 1 through 6. The means 231 is shown with portions of a fourth alternative carburetor 233 which has a throat, not shown, having a throat axis 234. The carburetor 233 is similar to the carburetor 10 of FIGS. 1 through 6, and has a spray tube, not shown, and first and second valve members 235 and 236 similarly cooperating with the spray tube. The valve member 235 has inner portions 239 having outwardly facing gear racks 241 and 242 extending from ends of the inner portions towards an outer portion 244 of the valve member. The second valve member 236 has inner portions 246 having inwardly facing gear racks 248 and 249 similarly extending from ends of the inner portions towards an outer portion 250 of the valve member. The outer portions 244 and 250 of the valve members have complementary undesignated first and second portions corresponding to the first and second portions 37, 38, 57 and 58 of FIGS. 5 and 6 which similarly enclose the fuel spray tube as in the previously described valve assembly 20.

A pair of similar gear wheels 251 and 252 are journalled for rotation on pins 253 and 254 extending from diametrically opposed central portions of a valve guide means 256 surrounding the throat, the guide means, which is not shown completely, supporting the valve members similarly to the previously described embodiments. The pins extend normally from the valve guide means so that the gear wheels are journalled for rotation about axes disposed parallel to the throat axis 234. Thus, the gear wheels are disposed on opposite sides of the throat and are journalled for rotation relative to the carburetor body. The racks 241 and 242 of the first valve member 235 are spaced apart at a distance less than the racks 248 and 249 of the second valve member so that on each side of the throat the gear rack of one valve member is disposed opposite to and spaced from the gear rack of the other valve member at a rack spacing 258. The spacing 258 is sufficient to accept the respective gear wheel therebetween as seen in FIG. 15 and each gear wheel engages the opposed racks of the valve members for coupling the valve members for simultaneous movement along the valve axis in opposite direction.

As seen in FIG. 14, the gear wheels are positioned on a diameter 260 of the throat disposed normally to the valve axis 234 and it can be seen that reaction forces between the gear wheel and the racks on one side of the throat are balanced by equal but opposite reaction forces between the gear wheel and its respective racks on the opposite side of the throat. Thus the reaction forces between the gear wheels and racks which normally tend to force opposed racks apart are balanced in this embodiment. This contrasts with the valve actuating means 23 of FIG. 1 in which the reactions between the gear wheels and the racks tending to force the valve members apart, that is away from each other, are resisted by the valve guide means, thus increasing friction between the valve members and the valve guide means.

Similar support blocks 262 and 263 are fitted on diametrically opposite sides of the gear wheel 251 and have inner faces 264 and 265 which are complementary to and spaced closely adjacent the gear wheel with sufficient clearance to prevent interference therebetween in normal operation. The complementary faces provide additional support for the gear wheel against lateral forces arising from engagement of the gear wheel with the valve plates. If the lateral forces are sufficiently high, deflection of the pin might otherwise occur and the deflection is restricted by interference between teeth of the gear wheel and the support block. If the carburetor is made from injection molded plastic material, this deflection is likely from the forces acting on the gear wheel and, should the pin shear, adequate support for the gear wheel can be provided by the support blocks, thus providing a relatively fail-safe mechanism. The gear wheel 252 has similar support blocks and thus a pair of support blocks are positioned between the opposed racks to straddle each gear wheel to provide the additional support as above and to provide essentially fail-safe valve actuating means which is desirable in a carburetor.

A further alternative carburetor (not shown) generally similar to the carburetor 200 has a fuel spray tube secured to the second valve member so as to move therewith, in which case a flexible fuel hose would be secured to the outer end of the fuel spray tube to move therewith. In this alternative, the fuel is discharged at a point which moves across the throat, thus producing non-uniform dispersion.

This in all alternative embodiments as above, the fuel needle cooperates with the bore of the fuel spray tube to serve as a variable flow restrictor which cooperates with the fuel jet to vary degree of restriction of the fuel jet. The flow restrictor is connected to the valve means so that relative position of the flow restrictor in the jet is related to volume of air flowing through the carburetor throat. In all embodiments except the last alternative, the fuel atomizing means discharged fuel symmetrically relative to the throat, and, in some cases, also distributes the fuel diametrically across the throat prior to discharge.

I claim:

1. A carburetor for mixing air and fuel prior to combustion, the carburetor having a body with a throat having a throat central axis and a sidewall, the carburetor being characterized by:

(a) a fuel spray tube having jet means and extending into the throat generally normally to the throat axis and being adapted to receive fuel and to discharge fuel into the throat, (b) a valve assembly having: a valve axis extending across the throat and normally to the throat central axis, first and second sliding gate valve members, and complementary valve guide means to mount the valve members for generally transverse sliding along the valve axis between closed and wide open positions; each valve member having an inner portion having an inner edge disposed generally symmetrically about the valve axis and shaped to correspond to approximately one half of the sidewall of the throat in the wide open position, the valve members being adapted to cooperate with each other so that inner portions thereof overlap each other to close essentially the throat when in the closed position, and also to cooperate with the the jet means of the fuel spray tube so as to open and close the jet means as required, (c) valve actuating means cooperating with the valve members to move the valve members concurrently in opposite directions between the respective open and closed positions in response to an operator control so that movement of the valve members controls the jet means, (d) fuel metering means responsive to valve position to meter fuel prior to being discharged from the fuel spray tube, (e) fuel atomizing means cooperating with the jet means of the fuel spray tube, so that fuel metered by the metering means atomizes and there is discharged into the throat an acceptable fuel mixture for combustion for all valve positions.

2. A carburetor as claimed in claim 1 in which the fuel atomizing means is characterized by the jet means of the fuel spray tube having:

(a) air bleed jet means spaced along the tube and facing generally upstream to inlet air flow so as to receive a portion of a ram air entering the carburetor, (b) discharge jet means spaced along the tube and positioned so as to be exposed to suction resulting from air flowing around the spray tube, the discharge jet means communicating with the air bleed jet means and a supply of metered fuel so that the metered fuel and the portion of ram air are discharged simultaneously through the discharge jet means, the discharge jet means being non-aligned with the air bleed jet means so that most of the air entering the air bleed jet means cannot pass directly out through the discharge jet means, and the carburetor is further characterized by:

(c) the fuel spray tube extending parallel to the valve axis and cooperating with the valve members so that the jet means adjacent opposite portions of the throat are progressively closed by the valve members as the valve assembly closes.

3. A carburetor as claimed in claim 2 in which:

(a) each valve member has first and second portions, each first portion having a face with an axial groove to accept approximately one-half of the fuel spray tube, the face extending inwards from the second portion to the inner edge of the valve member; each second portion having an axially disposed passage aligned with the respective groove in the face of the first portion so as to accept the fuel spray tube, (b) the valve members are mounted in the valve guide means in opposite relationship to each other so that when the carburetor is closed, faces of the first portions are positioned so as to be complementary to each other and the passages and grooves of the valve members are mutually aligned for all positions of the valve members, thus permitting free sliding of the valve members along the tube to open and close the air bleed and the discharge jet means, and to permit essential closure of the valve due to overlapping of the inner portions of valve members.

4. A carburetor as claimed in claim 3 in which:

(a) the carburetor throat has a cylindrical side wall, (b) the spray tube is disposed diametrically across the throat, and in which each valve member is further characterized by:

(c) the first portion having a pair of spaced parallel side edges adapted to slide in the valve guide means, and the inner edge of the first portion having a concave semi-circular inner edge similar to the cylindrical side wall of the throat, (d) the second portion having a convex semi-cylindrical inner wall spaced inwards from the inner edge of the first portion a distance on the valve axis defining valve overlap, the groove on the face of the first portion extending between mid-positions of the convex and concave end walls, thickness of the second portion being approximately twice thickness of the first portion, the valve members being disposed in the valve guide means so that when the carburetor is closed the concave inner edge and convex inner wall of one valve member are complementary to the convex inner wall and concave inner edge respectively of the other valve member.

5. A carburetor as claimed in claim 1 in which the fuel atomizing means is characterized by the fuel spray tube having:

(a) a plurality of air bleed jets spaced along the tube and facing generally upstream to inlet air flow so as to receive a portion of ram air entering the carburetor, (b) a plurality of discharge jets spaced along the tube and positioned so as to be exposed to suction resulting from air flowing around the spray tube, (c) a manifold connecting the air bleed jets to the discharge jets and extending essentially across the throat, (d) a fuel orifice communicating the manifold with the fuel metering means and disposed approximately mid-way across the throat so as to supply metered fuel from the metering means to a mid position of the manifold to provide a generally even distribution of fuel to the discharge jets, so that, in operation, a portion of air entering the carburetor throat enters the fuel spray tube through the air bleed jets and passes through the manifold to leave the fuel spray tube through the discharge jets, which portion of air concurrently mixes initially with metered fuel passing through the fuel orifice to form a relatively rich primary air/fuel mixture in the manifold, and then discharges through the discharge jets for subsequent mixing with air in the throat downstream of the spray tube to produce a desired leaner air/fuel mixture for combustion.

6. A carburetor as claimed in claim 5 in which the fuel metering means has a fuel inlet connected to a fuel supply and further includes:

(a) a fuel flow jet connecting the fuel inlet with the manifold, (b) a variable fuel flow restrictor cooperating with the fuel flow jet to vary degree of restriction of the fuel flow jet, the flow restrictor being connected to a valve member so that relative position of the flow restrictor in the fuel flow jet is dependent on position of the valve members.

7. A carburetor as claimed in claim 6 in which:

(a) the fuel flow restrictor is a needle having a cross-sectional area which varies along the length of the needle so that when the needle cooperates with the fuel flow jet the fuel flow is metered an amount dependent on cross-sectional area of a portion of the needle cooperating with the jet, the carburetor further including:

(b) coupling means to connect the needle to the valve means, so that relative position of the needle in the jet is related to the valve position.

8. A carburetor as claimed in claim 7 in which:

(a) the fuel flow jet and the fuel flow restrictor are positioned within the fuel spray tube, the tube having a longitudinal slot having a length at least equal to total stroke of one valve member, (b) the coupling means is an arm extending from the needle and passing through the longitudinal slot to connect an adjacent valve member to the needle, so that axial movement of the valve member is reflected by the needle.

9. A carburetor as claimed in claim 1 in which the valve actuating means include:

(a) rotatable means journalled for rotation relative to the carburetor and cooperating with the valve members so that rotation of the rotatable means moves the valve members concurrently equal amounts in opposite directions.

10. A carburetor as claimed in claim 9 in which:

(a) the rotatable means is a pair of gear wheels journalled for rotation about axis disposed normally to the throat axis, the gear wheels straddling the throat, (b) the valve members have opposed inner faces provided with gear racks complementary to and on opposite sides of the gear wheels for forming rack and pinion valve mechanisms, for coupling the valve members for simultaneous movement along the valve axis.

11. A carburetor as claimed in claim 9 in which:

(a) the rotatable means is a lever journalled for rotation at the mid-point thereof, the valve actuating means further including:

(b) a pair of links having inner ends connected to the lever and outer ends constrained to move in planes parallel to the valve axis, each outer end cooperating with a respective valve member.

12. A carburetor as claimed in claim 1 in which the fuel atomizing means is characterized by the fuel spray tube having:

(a) air bleed jet means spaced along the tube and facing generally upstream to inlet air flow so as to receive a portion of a ram air entering the carburetor, (b) discharge jet means spaced along the tube and positioned so as to be exposed to suction resulting from air flowing around the spray tube, the discharge jet means communicating with the air bleed jet means and a supply of metered fuel so that the metered fuel and the portion of ram air are discharged simultaneously through the discharge jet means, the discharge jet means being non-aligned with the air bleed jet means so that most of the air entering the air bleed jet means cannot pass directly out through the discharge jet means, and the carburetor is further characterized by:

(c) the fuel spray tube extending normally to the valve axis and cooperating with the valve members so that jet means adjacent opposite portions of the throat are progressively closed by the valve members as the valve assembly closes.

13. A carburetor as claimed in claim 1 in which:

(a) the first and second valve members are generally flat plates, (b) the fuel atomizing means is characterized by the fuel spray tube having a plurality of jets spaced along the tube, and the fuel spray tube is positioned adjacent the valve members so that the valve members close the jets as required, so that the jets adjacent opposite portions of the carburetor throat are progressively closed by the valve members as the valve assembly closes.

14. A carburetor as claimed in claim 1 in which the fuel metering and fuel atomizing means are characterized by:

(a) the fuel spray tube extending partially across the throat from one side thereof parallel to the valve axis, the tube having an inner end face and a longitudinal bore extending from the inner end face to discharge fuel into the throat, (b) the first valve member is positioned on a side of the throat opposite to the fuel spray tube and has a clearance bore to accept the fuel spray tube to permit the valve members to close, (c) a fuel needle extending from the first valve member and aligned with the longitudinal bore of the fuel spray tube so as to enter the longitudinal bore, the fuel needle having a cross-sectional area which varies along the length thereof, so that when the fuel needle extends into the longitudinal bore, flow of fuel discharged from the longitudinal bore is restricted in an amount dependent upon relative position of the first valve member to the inner end of the fuel tube.

15. A carburetor as claimed in claim 14 in which:

(a) the fuel spray tube extends from the side of the carburetor throat half way across the throat so that the inner end thereof is positioned adjacent a central axis of the throat, (b) the second valve member has a clearance passage to accept the fuel spray tube as a sliding fit, permitting the second valve member to slide axially relative to the fuel tube, (c) the fuel needle extends from a position adjacent the inner edge of the first valve member and tapers to an outer end of the needle.

16. A carburetor as claimed in claim 1 in which the fuel atomizing means is characterized by the fuel spray tube having:

(a) air bleed jet means facing generally upstream to inlet air flow so as to receive a portion of ram air entering the carburetor, the air bleed jet means extending essentially between the throat sidewall, (b) discharge jet means positioned so as to be exposed to suction resulting from air flowing around the spray tube, the discharge jet means extending between the throat sidewall and being non-aligned with the air bleed jet means so that most of the air entering the air bleed jet means cannot pass directly out through the discharge jet means, (c) a manifold communicating with the air bleed and discharge jet means and extending along the spray tube between extreme outer positions of the air bleed jet means and the discharge jet means, (d) a fuel orifice communicating the manifold with the fuel metering means and disposed relative to the air bleed jet means so as to be essentially sheltered from direct flow of air entering the air bleed jet means, and positioned approximately mid-way across the throat so as to supply metered fuel from the metering means to a mid-position of the manifold to provide a generally even distribution of fuel to the discharge jet means, so that, in operation, a portion of air entering the carburetor throat enters the fuel spray tube through the air bleed jet means and passes through the manifold to leave the fuel spray tube through the discharge jet means, which portion of air concurrently mixes initially with metered fuel passing through the fuel orifice to form a relatively rich primary air/fuel mixture in the manifold, and then discharges through the discharge jets for subsequent mixing with air in the throat downstream of the spray tube to produce a desired leaner air/fuel mixture for combustion.

17. A carburetor as claimed in claim 7 in which the needle has:

(a) a tapered outer end passing through the fuel flow jet, (b) a flat portion inclined to a central axis of the needle so that cross-sectional area of the needle varies along the length thereof, the flat portion being disposed adjacent the fuel orifice so as to provide a relatively direct route between the fuel jet and the fuel orifice.

18. A carburetor as claimed in claim 9 in which:

(a) the rotatable means is a pair of gear wheels journalled for rotation relative to the carburetor body about axes disposed parallel to the throat axis, the gear wheels being disposed on opposite sides of the throat, (b) inner portions of the first valve member have outwardly facing gear racks, and inner portions of the second valve member have inwardly facing gear racks, the inner portions straddling the throat so that on each side of the throat the gear racks of one valve member are disposed opposite to and spaced from the gear rack of the other valve member at a rack spacing sufficient to accept the respective gear wheel therebetween, so that each gear wheel engages the opposed racks of the valve member for coupling the valve members for simultaneous movement along the valve axis in opposite directions.

19. A carburetor as claimed in claim 18 in which:

(a) the gear wheels are positioned on a diameter of the throat disposed normally to the valve axis, (b) a pair of support blocks positioned between the opposed racks straddle each gear wheel and have inner faces complementary to and spaced closely adjacent the gear wheel so as to provide additional support for the gear wheel against lateral forces.

20. A carburetor as claimed in claim 5 in which the fuel spray tube is characterized by:

(a) an outer sleeve extending across the throat and having a central bore, and the air bleed and discharge jets therein, (b) an inner tube having a central bore to receive fuel extends within the outer tube, space between the inner tube and outer sleeve defining a portion of the manifold, the inner tube having the fuel orifice therein.

21. A carburetor as claimed in claim 20 in which:

(a) the inner tube is divided into two portions having opposed end faces spaced apart adjacent a mid position of the throat so as to expose the central bore, so that an end of one portion serves as the fuel orifice.

22. A fuel atomizing means for use in a carburetor having a body with a throat having a throat central axis and a throat sidewall, a valve means for controlling air flow through the throat, and fuel supply means to supply metered fuel to the atomizing means; the fuel atomizing means having a fuel spray tube extending into the throat generally normally to the throat central axis and characterized by:

(a) an air bleed jet means facing generally upstream to inlet air flow so as to receive a portion of ram air entering the carburetor, the air bleed jet means extending essentially between the throat sidewall, (b) discharge jet means positioned so as to be exposed to suction resulting from air flowing around the spray tube, the discharge jet means extending between the throat sidewall and being non-aligned with the air bleed jet means so that most of the air entering the air bleed jet means cannot pass directly out through the discharge jet means, (c) a manifold communicating with the air bleed and discharge jet means and extending along the spray tube between extreme outer positions of the air bleed jet means and the discharge jet means, (d) a fuel orifice communicating the manifold with the fuel supply means and disposed relative to the air bleed jet means so as to be essentially sheltered from direct flow of air entering the air bleed jet means, and positioned approximately mid-way across the throat so as to supply metered fuel from the supply means to a mid-position of the manifold to provide a generally even distribution of fuel to the discharge jet means, so that, in operation, a portion of air entering the carburetor throat enters the fuel spray tube through the air bleed jet means and passes through the manifold to leave the fuel spray tube through the discharge jet means, which portion of air concurrently mixes initially with metered fuel passing through the fuel orifice to form a relatively rich primary air/fuel mixture in the manifold and then discharges through the discharge jet means for subsequent mixing with the air in the throat downstream of the spray tube to produce a desired leaner air/fuel mixture for combustion.

23. A fuel atomizing means as claimed in claim 22 in which the fuel spray tube is further characterized by:

(a) an outer sleeve extending across the throat and having a central bore, and the air bleed and discharge jets therein, (b) an inner tube having a central bore to receive fuel extends within the outer tube, space between the inner tube and outer sleeve defining a portion of the manifold, the inner tube having the fuel orifice therein.

24. A fuel atomizing means as claimed in claim 23 in which:

(a) the inner tube is divided into two portions having opposed end faces spaced apart adjacent a mid position of the throat so as to expose the central bore, so that an end of one portion serves as the fuel orifice.

25. A fuel atomizing means as claimed in claim 22 in which the fuel spray tube includes a fuel metering means which is characterized by:

(a) a fuel flow jet connecting the fuel inlet with the manifold, and a variable flow restrictor cooperating with the fuel flow jet to vary degree of restriction of the fuel flow jet, the flow restrictor being connected to the valve means, so that relative position of the flow restrictor in the fuel flow jet is related to air flowing through the carburetor throat.

26. A fuel atomizing means as claimed in claim 25 in which:

(a) the flow restrictor is a needle having a cross-sectional area which varies along the length of the needle so that when the needle cooperates with the fuel flow jet the fuel flow is metered an amount dependent on the cross-sectional area of a portion of the needle cooperating with the jet, the carburetor further including:

(b) coupling means to connect the needle to the valve means, so that the relative position of the needle in the jet is related to the valve position.

27. A fuel atomizing means as claimed in claim 26 in which the needle has:

(a) a tapered outer end passing through the fuel flow jet, (b) a flat portion inclined to a central axis of the needle so that cross-sectional area of the needle varies along the length thereof, the flat portion being disposed adjacent the fuel orifice so as to provide a relatively direct route between the fuel jet and the fuel orifice.

28. A fuel atomizing means as claimed in claim 22 in which the valve means for controlling air flow through the carburetor throat includes a valve assembly mounted adjacent the fuel spray tube, the valve assembly being characterized by:

(a) a valve axis extending across the throat, first and second sliding gate valve members and complementary valve guide means to mount the valve members for generally transverse sliding along the axis between closed and wide open positions, each valve member having an inner portion having an inner edge shaped to approximate to a portion of the side wall of the throat when in the wide open position, the valve members being adapted to cooperate with each other so as to close essentially the throat in the closed position.

* * * * *